United States Patent [19]

Brown et al.

[11] 4,275,086

[45] Jun. 23, 1981

[54] METHOD OF PREPARING POTATO SEGMENTS

[75] Inventors: Roger A. Brown, Tigard, Oreg.; William F. Clyde, American Falls, Id.; Glenn D. Galusha, Moses Lake, Wash.

[73] Assignee: AMFAC Foods, Inc., Portland, Oreg.

[21] Appl. No.: 965,947

[22] Filed: Dec. 4, 1978

Related U.S. Application Data

[63] Continuation of Ser. No. 836,050, Sep. 23, 1977, abandoned.

[51] Int. Cl.[3] ..... B02C 18/00

[52] U.S. Cl. ..... 426/518; 83/27; 83/425.3; 426/438

[58] Field of Search ..... 426/518, 509, 584, 523, 426/464, 473, 809, 438, 481, 482; 83/858, 857, 425.3, 27; 99/537, 538, 589

[56] References Cited

U.S. PATENT DOCUMENTS

| | | | |
|---|---|---|---|
| Re. 26,796 | 2/1970 | Lamb | 426/482 |
| 608,368 | 8/1898 | Lawson | 83/425.3 |
| 2,801,661 | 8/1957 | Miller | 83/425.3 X |
| 3,057,386 | 10/1962 | Massaro | 426/518 |
| 3,116,772 | 1/1964 | Lamb et al. | 83/27 |
| 3,236,276 | 2/1966 | Farmer | 426/518 X |
| 3,473,588 | 10/1969 | Loveland | 426/484 X |
| 3,644,129 | 2/1972 | Sloan | 426/509 |
| 3,753,736 | 8/1973 | Barker | 426/518 X |
| 3,780,641 | 12/1973 | Hole | 426/518 X |
| 4,135,002 | 1/1979 | Hodges et al. | 426/482 |

OTHER PUBLICATIONS

Webster's New World Dictionary, Second College Edition, World Publishing Co., N.Y., 1972, p. 312.

Talburt, Potato Processing, The AVI Pub. Co. Inc., Westport, Conn., 1967, p. 351.

*Primary Examiner*—Joseph M. Golian
*Assistant Examiner*—George C. Yeung
*Attorney, Agent, or Firm*—Klarquist, Sparkman, Campbell, Leigh, Whinston and Dellett

[57] ABSTRACT

An apparatus and method are disclosed for cutting French fries or other elongated vegetable segments which undergo a processing step, so as to maximize the uniformity of a desirable segment characteristic after processing. To obtain French fries which cook to a substantially uniform degree of "doneness" after blanching, cutter blades are positioned to cut segments or smaller cross-sectional dimensions through the lower solids content pith at the center of a potato, and to cut segments of larger cross-sectional dimensions from the higher solids content portions of the potato.

3 Claims, 6 Drawing Figures

METHOD OF PREPARING POTATO SEGMENTS

This is a continuation of application Ser. No. 836,050, filed Sept. 23, 1977, now abandoned.

BACKGROUND OF THE INVENTION

The present invention relates to an improved method and apparatus for the slicing of vegetables, and more particularly is related to the slicing of potatoes for production of French fried potatoes.

The high speed production of elongated vegetable slices such as French fried potato slices has been accomplished by a wide variety of devices such as motor driven circular slicers, grids of tensioned wires, and the like. An especially advantageous apparatus and method for slicing such elongated slices are disclosed in U.S. Pat. Nos. 3,109,468 and 3,116,772 to Lamb et al., which were respectively issued Nov. 5, 1963 and Jan. 7, 1964. These patents disclose a grid of staggered blades through which oriented potatoes are forced at a high speed.

Each of the prior art processes has been more or less effective in producing French fries which have a pleasing appearance characterized by a uniformity of cross-sectional dimensions among all the French fries produced. While this uniformity of size may be visually pleasing, it does not insure that such fries will have other uniform characteristics after processing. Because potatoes do not have a uniform composition throughout their entire volume, fries of several different compositions will be cut from each potato. The characteristics of each blanched and cooked fry at least partially depends on the fry's composition; so cooked, uniformly shaped fries from a single potato can vary widely. For instance, an optimally cooked batch of uniformly shaped fries is a compromised mixture which includes both overcooked and undercooked fries.

SUMMARY OF THE INVENTION

The apparatus and method of the present invention substantially reduce the problem of disparate characteristics among processed fries in a given batch. Nonuniformly shaped, elongated segments are cut from a potato in such fashion that after processing, some desired characteristic of the processed segments more closely approximates a set standard. To attain this goal the potatoes are sliced so that fries cut from the lower solids center portion of potatoes have certain average cross-sectional dimensions while fries cut from the higher solids content outer portions of the potatoes have different average cross-sectional dimensions. Thus, slicing according to the present invention compensates for the variation of solids content among segments cut from different portions of a potato.

For example, if uniform "doneness" or texture is a desired final characteristic, segments with relatively small cross-sectional dimensions are taken from the center of the potato and larger dimensioned segments from the outer portions. On the average, fries cut in this fashion are closer to a median degree of "doneness" after batch blanching and cooking than are prior art uniformly dimensioned French fries processed at the same conditions. As an ultimate result, the process of this invention can be used to produce fries which cook to a more uniform texture and degree of "doneness" than has heretofore been obtained.

DESCRIPTION OF THE PREFERRED EMBODIMENT

Figure 1:
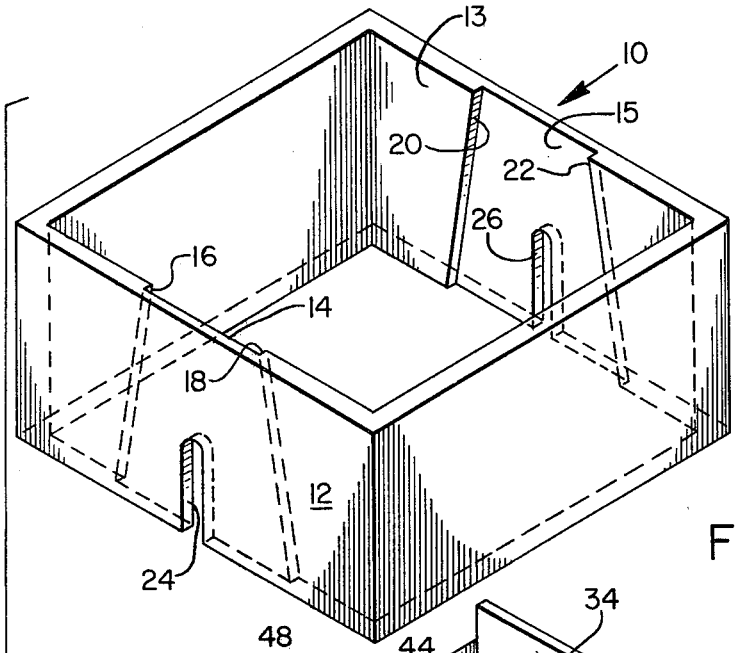
FIG. 1 is an exploded projection view of a preferred cutter element according to the present invention.

The process of the present invention can be performed on many types of prior art vegetable slicing equipment, such as apparatus which employ rotary blade or tensioned wire cutting means. Preferred, however, is an apparatus which employs fixed, staggered blades such as the cutting means described in the previously mentioned patents of Lamb et al. A cutter assembly for use in such an apparatus includes a cutter box assembly 10, here shown as being square in configuration, having two opposed end plates 12, 13 which are grooved at 14 and 15 respectively. Use of the cutter assembly will be described in connection with the slicing of potatoes. Each groove has pyramidal sides such as those indicated on the end plate 12 at 16 and 18, and upon the end plate 13 at 20 and 22. The sides of the grooves 14, 15 angle toward each other at about 9° to the vertical.

The end plates 12, 13 are respectively provided with slots 24, 26. These slots accommodate appropriate bolts 28, 30 by which a cutter housing 31 can be fixed within the box assembly 10. Each of the pyramidal grooves or channels 14, 15 are in turn adapted to receive one of two cutter housing end plates 32, 34, which directly support two side cutters 36, 38. It will be seen that the ends of each of the side cutter blades 36, 38 are dove-tailed in between the edges of the plates 32, 34 and thereby mounted between the grooves 14 and 15 when the cutter housing is secured in the cutter box assembly.

The two cutter blades 36, 38 may be considered knives with which to remove the outside portions or slabs S of a potato on the two corresponding sides thereof. Corresponding cutter blades for removing two other slabs S of the potato are found in blades 44, 46. These are mounted right angularly to the exterior blades 36, 38 and, like the latter, are in parallel alignment. They are so spaced from the end plates 32, 34 as to form in the potato a center cut section defined by the blades 36, 44, 38, and 46. Slab removal is accomplished by feeding a potato through the cutter housing from its infeed end in the direction shown by an arrow 48.

Figure 2:
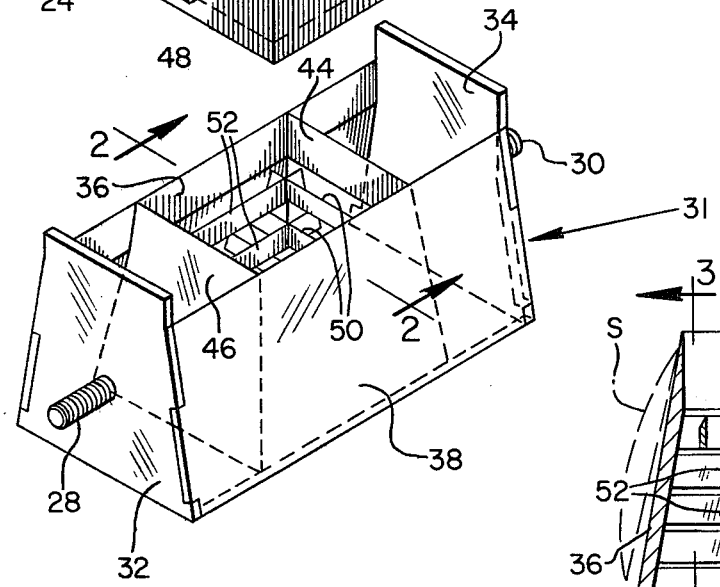
FIG. 2 is a sectional view taken along lines 2—2 of FIG. 1.
Figure 2:
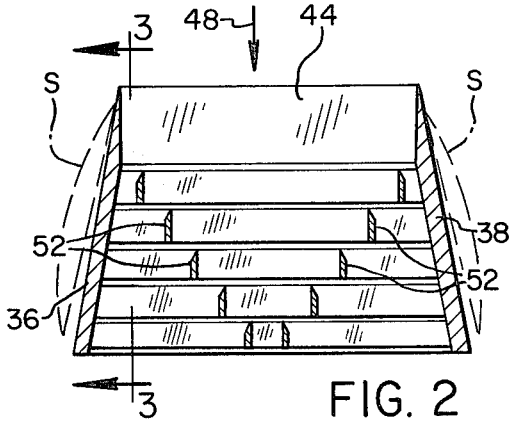
Figure 3:
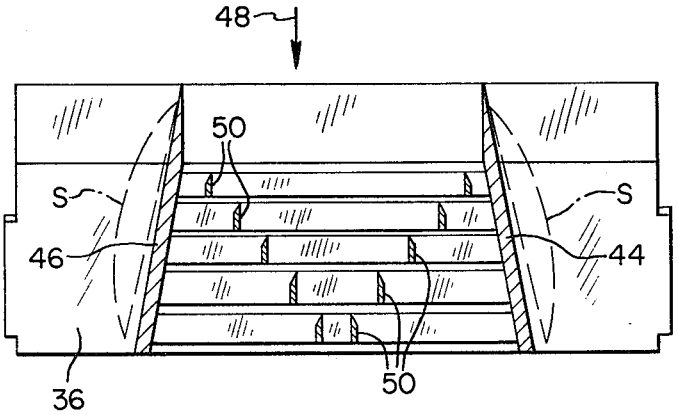
FIG. 3 is a sectional view taken along lines 3—3 of FIG. 2.

Within the center cut area defined by blades 36, 38, 44 and 46 are mounted additional series of blades so spaced (both laterally and vertically) that the potato is cut or sliced into strips or segments the length of the potato. In FIGS. 2 and 3 it is seen that a series of central blades 50 intersects at right angles a like series of central blades 52. The outermost blades of each series are positioned with their cutting edges adjacent the infeed end of the cutter housing. The other blade edges successively recede from the infeed end so that the cutting edges of blades nearest the center of the series are most distant from the infeed end.

The arrangement of FIGS. 2 and 3, which is specifically for slicing French fry segments from processing-variety potatoes, includes twenty central blades, ten in each series. With this arrangement, potatoes of sufficient size are cut into one hundred twenty-one longitudinal strips. Fewer strips are taken from potatoes having smaller cross-sectional dimensions than the area defined by the blades 36, 38, 44, 46.

Figure 5:
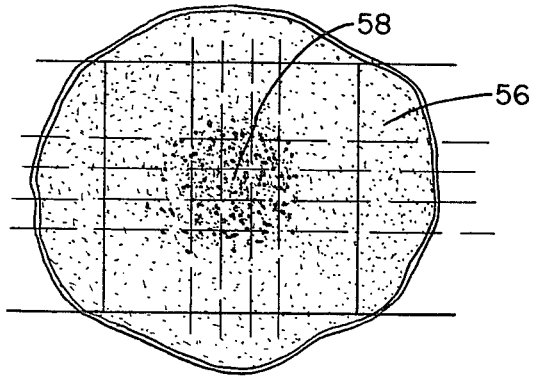
FIG. 5 is a schematic sectional view of a typical processing-variety potato.

The spacing of the blades of each series is critical to the present invention because vegetables such as potatoes and carrots do not have a uniform solids content, cell structure or chemical composition throughout their entire cross section. For instance, potatoes have a higher solids content outer portion 56 (lightly shaded area in FIG. 5) and lower solids content inner portion 58 commonly called pith (heavily shaded area in FIG. 5). Due to this variation in internal composition, blanching tends to produce more gelatenized starch in segments cut from the higher solids content portion than in segments cut from the pith. The amount of gelatenized starch in a given segment determines its texture after a subsequent cooking step and thus a variety of different product textures are commonly observed among the segments in any cooked batch of uniformly dimensioned segments. It has been found, however, that starch gelatenizes more quickly in segments having relatively small cross-sectional dimensions than in segments having relatively large cross-sectional dimensions during blanching at identical conditions, because heat is transferred more readily to the interiors of segments having smaller cross-sectional dimensions.

The size and shape of segments can thus be varied to at least partially offset the effect of non-homogenous vegetable composition on the uniformity of cooked product texture. For example, French fry segments can be cut to obtain a more uniform degree of "doneness" after blanching and cooking by spacing the edges of blades 50, 52 more closely together at the centers of the blade series which they respectively comprise, than at the outer edges thereof so that segments of smaller cross-sectional dimensions are cut from a potato's pith and segments of larger dimensions from the outer higher solids content portion. With such a blade arrangement, the segments on the average have cross-sectional dimensions that are a function of the segment's percent solids content and of the segment's distance from the center of the potato at the time of cutting.

It is known that an object's linear dimensions directly determine its surface area and volume and that volume changes more rapidly than surface area as linear dimensions of the object change. The potato segments of smaller cross-sectional dimensions cut from the potato's pith thus have a greater surface area to volume ratio than the segments of larger dimensions cut from the potato's outer portion; and the ratio of segment surface area to volume is generally inversely proportional to the distance of a segment from the center of the potato.

Optimum blade spacings for the cutting of potatoes or any other vegetable may be determined by experimentation. This is accomplished by cutting segments from a vegetable with blades set at proposed positions and then measuring the extent to which segments deviate from a standard target characteristic after being processed and cooked together at standard conditions. The resulting data is then used to select a favorable blade spacing arrangement which produces segments dimensioned to have increasedly uniform characteristics after processing and cooking.

One favorable blade arrangement for cutting French fries from processing variety potatoes, such as Russet-Burbank potatoes, includes blades spaced successively further apart toward the outer edges of each blade series. A modified version of this arrangement, illustrated in FIG. 4, includes a first series of blades 50 having two transition blades $T_1$ located equidistant from the center point C of the cutter housing. Likewise a second series of blades 52 has two parallel transition blades $T_2$. To simplify discussion, each of the two blade series can be considered to include three subseries. The first series of blades 50 has a center subseries $Sc_1$, which includes both the transition blades $T_1$ and blades located therebetween, and also has two outer subseries $So_1$, each of which includes one of the transition blades $T_1$ and all blades located outwardly of and parallel to that transition blade. Likewise, the second series of blades 52 has a center subseries $Sc_2$, which includes both the transition blades $T_2$ and the blades located therebetween, and also has two outer subseries $So_2$, each of which includes one of the transition blades $T_2$ and all blades located outwardly of and parallel to that transition blade. The spacing of blades within any one of the aforesaid subseries is uniform, but the spacing of blades in one subseries may differ from the spacing of blades in another.

Figure 4:
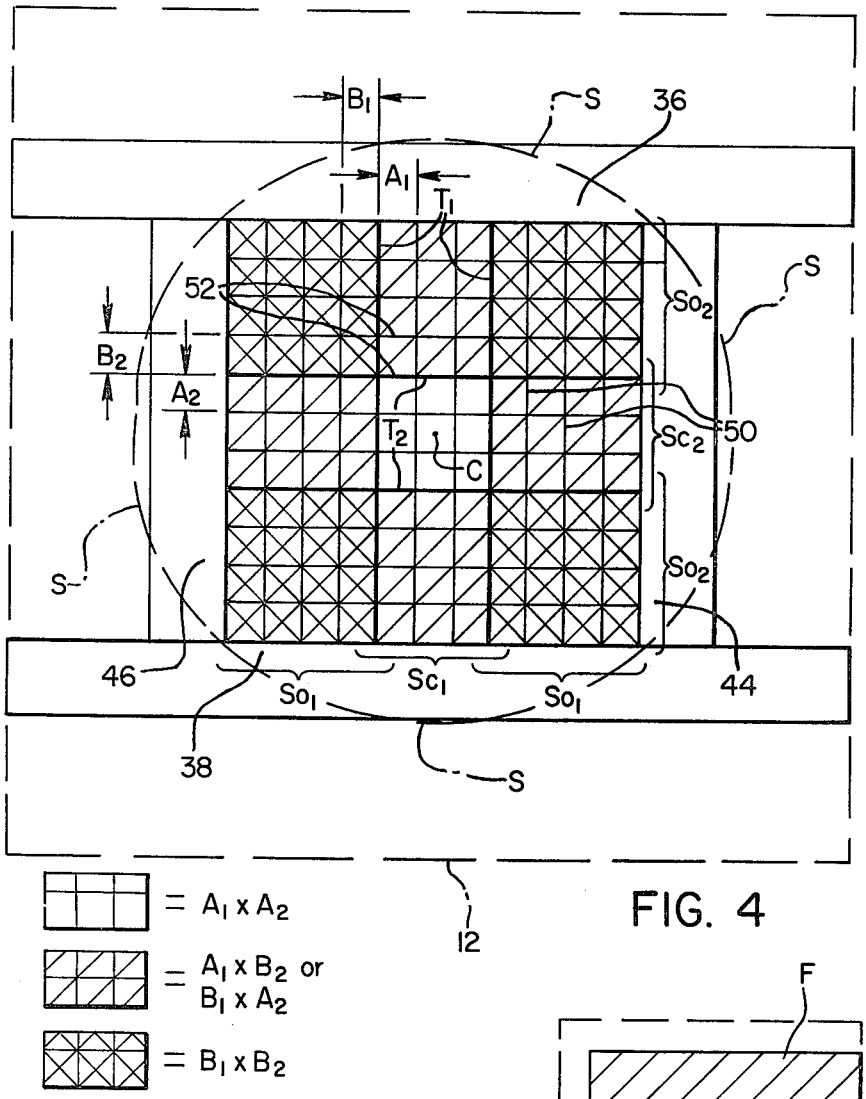
FIG. 4 is a schematic view of the lateral displacement of blades in a cutter element according to the present invention.

As previously described, potatoes have an area of low solids content at their centers, so blades of the outer subseries are spaced a greater distance apart than are the blades of the center subseries to provide fries which cook to an improved degree of textural uniformity. Referring specifically to FIG. 4, the blades of the center subseries $Sc_1$ are spaced at a distance of $A_1$ which is less than the spacing distance $B_1$ of the outer subseries $So_1$ blades. Likewise, blades of the center subseries $Sc_2$ are spaced apart a distance of $A_2$ which is less than the spacing $B_2$ of blades in the outer subseries $So_2$.

Using a cutter apparatus having this blade spacing, segments cut by perpendicular blades of both the center subseries (in FIG. 4 those blades in the unhatched area defined by the four transition blades $T_1$, $T_2$) have a rectangular cross section of $A_1 \times A_2$. Segments cut by blades of one center subseries and perpendicular blades of one outer subseries (in FIG. 4 those blades in the four cross-hatched areas defined by three of the transition blades $T_1$, $T_2$ and one of the side center blades 36, 38, 44, 46) have larger, rectangular cross-sectional areas of either $A_1 \times B_2$ or $B_1 \times A_2$. Segments cut by perpendicular blades of two outer subseries (in FIG. 4 those blades in the four double-cross-hatched areas defined by two of the transition blades $T_1$, $T_2$ and two of the slab cutter blades 36, 38, 44, 46) have still larger, rectangular cross sections of $B_1 \times B_2$. The subseries of blades used to cut fries of each of the above named dimensions is shown in Table I.

TABLE I

| Fry Dimensions | Blade Subseries Used in Cutting |
|---|---|
| $A_1 \times A_2$ | $Sc_1$, $Sc_2$ |
| $A_1 \times B_2$ | $Sc_1$, $So_2$ |
| $B_1 \times A_2$ | $So_1$, $Sc_2$ |
| $B_1 \times B_2$ | $So_1$, $So_2$ |

Figure 6:
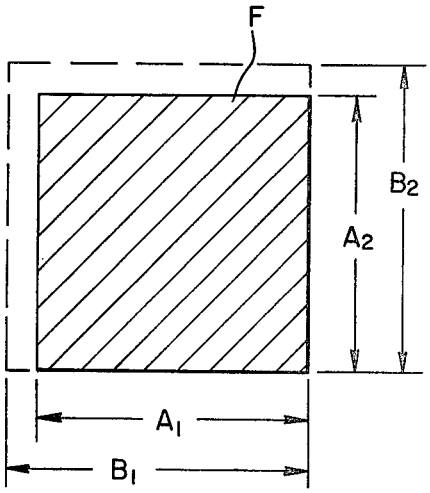
FIG. 6 is a schematic cross-sectional view of an elongated potato slice produced according to the process of the present invention.

FIG. 6 is an enlarged cross-sectional view of a French fry segment F cut by the blade arrangement preferred for use with the Russet-Burbank potato. This figure shows the relative cross-sectional dimensions of the different segments cut by the assembly.

Fries cut by the disclosed apparatus do not each perfectly match a standard ratio of solids content to surface area or cross-sectional perimeter, but on the average, they more closely meet a standard ratio than do the uniformly shaped potato segments of the prior art. To maximize the uniformity of slice shapes, it is preferred to space the blades so that $A_1$ equals $A_2$ and that $B_1$ equals $B_2$.

By experimentation, a preferred spacing arrangement has been devised for cutting French fry segments longitudinally through processing-variety potatoes. In this arrangement the center subseries spacings $A_1$, $A_2$ are both 9/32 inch and the outer subseries spacings $B_1$, $B_2$ are both 19/64 inch. At these spacings, a cutter apparatus for processing No. 2 or larger potatoes preferably includes four blades in each center subseries and five blades in each outer subseries. After blanching, freezing and cooking, fries cut by an apparatus using this spacing arrangement have a significantly uniform texture and are sufficiently similar in shape that the absence of size uniformity is not noticeable except upon close examination.

OPERATION

A selected vegetable is sliced according to the normal mode of operation for the type of slicing apparatus used; but the segments are taken so that they have the differing cross-sectional dimensions described above. On the average, a segment's dimensions are some function of its physical characteristics which effect the rate at which it undergoes processing. The dimensions might, for example, be related to a segment's solids content, the average size of its cells or its distance from the center of the vegetable at the time of cutting. The function is selected by experimentation so that some characteristic of the processed segments will approach uniformity.

While we have shown and described a preferred embodiment of our invention, it will be apparent to those skilled in the art that changes and modifications may be made without departing from our invention in its broader aspects. For instance, the above specification has specifically described varying segment dimensions to accommodate different solids contents and thereby achieve a uniform degree of segment texture or "doneness" in the final product. The disclosed technique and apparatus for cutting variable dimension segments could also be used to optimize the uniformity of other final product characteristics such as flavor, salt content or the like. And, if segments undergo processing steps besides blanching, freezing and cooking or if the final product goal is other than "doneness" uniformity, the segment characteristic which dictates optimum blade spacing may be unrelated to solids content of the vegetable. Chemical composition or cell size, for example, are factors which could determine the preferred blade spacing to achieve uniformity of certain end product characteristics.

We claim:

1. A method of cooking a mixture of elongated potato segments cut from various portions of a potato having a higher starch containing solids content in its outer portions than in its inner portion, comprising:

making a series of longitudinal cuts through said potato to divide it into multiple, elongated segments, said cuts being spaced a selected distance apart in said inner portion of said potato, and a distance apart greater than said selected distance in said outer portions of said potato, and said cuts being located to make the ratio of segment surface area to volume generally inversely proportional to the distance of a segment from the center of said potato;

combining said segments to form a mixture thereof; and, blanching and cooking said mixture, whereby variations in segment texture, as measured by the amount of gelatinized starch per segment, are minimized, and segments of substantially the same texture are obtained.

2. A method as in claim 1, in which said cuts comprise two series of cuts, each of said series being perpendicular to the other.

3. A method as in claim 2, in which said cuts comprise parallel cuts to produce segments with generally rectangular cross sections.

* * * * *